US007735610B2

(12) United States Patent
Huard et al.

(10) Patent No.: US 7,735,610 B2
(45) Date of Patent: Jun. 15, 2010

(54) METHOD FOR CONTROLLING A BRAKING UNIT OF A ROPE TRANSPORT INSTALLATION AND BRAKING UNIT

(75) Inventors: Jean-Paul Huard, Saint Jorioz (FR); Daniel Michel, Proveysieux (FR); Jean-Christophe Chouvellon, Saint Jean de Moirans (FR)

(73) Assignee: Pomagalski S.A., Fontaine (FR)

( * ) Notice: Subject to any disclaimer, the term of this patent is extended or adjusted under 35 U.S.C. 154(b) by 548 days.

(21) Appl. No.: 11/822,668

(22) Filed: Jul. 9, 2007

(65) Prior Publication Data

US 2008/0029348 A1 Feb. 7, 2008

(30) Foreign Application Priority Data

Aug. 4, 2006 (FR) ..... 06 07174

(51) Int. Cl.
*B66B 1/32* (2006.01)
*B66B 5/04* (2006.01)

(52) U.S. Cl. ..... 187/288; 187/305; 187/287; 187/393

(58) Field of Classification Search ..... 187/276, 187/277, 281, 286–288, 293, 295, 296, 302, 187/305, 393

See application file for complete search history.

(56) References Cited

U.S. PATENT DOCUMENTS 3,759,350 A * 9/1973 Caputo et al. ..... 187/295
4,319,665 A * 3/1982 Komuro et al. ..... 187/296
5,323,878 A 6/1994 Nakamura et al.
5,421,432 A * 6/1995 Strambi et al. ..... 187/288
7,228,943 B2 * 6/2007 Kugiya et al. ..... 187/393
7,448,472 B2 * 11/2008 Kugiya et al. ..... 187/305
7,578,373 B2 * 8/2009 Shiratsuki et al. ..... 187/391
2004/0173413 A1 9/2004 Angst et al.
2009/0133964 A1 * 5/2009 Ueda et al. ..... 187/254
2009/0229924 A1 * 9/2009 Kondo et al. ..... 187/288

FOREIGN PATENT DOCUMENTS

DE 103 92 710 T5 9/2005
WO WO 03/004397 A1 1/2003

* cited by examiner

*Primary Examiner*—Walter Benson
*Assistant Examiner*—Eduardo Colon-Santana
(74) *Attorney, Agent, or Firm*—Oliff & Berridge, PLC

(57) ABSTRACT

The invention relates to a method for controlling a braking unit of a rope transport installation and braking unit. The command signals of a first brake are modulated, until the installation is stopped, by a first modulation circuit integrated in the control unit to automatically regulate the running speed of the rope according to a first predetermined deceleration setpoint curve activated by a braking order. The command signals of a second brake are simultaneously modulated by a second modulation circuit integrated in the control unit to automatically regulate the running speed of the rope according to a second predetermined deceleration setpoint curve activated by the braking order, the instantaneous value of the second setpoint curve being at all times greater than the value of the first setpoint curve.

10 Claims, 4 Drawing Sheets

METHOD FOR CONTROLLING A BRAKING UNIT OF A ROPE TRANSPORT INSTALLATION AND BRAKING UNIT

BACKGROUND OF THE INVENTION

The invention relates to a method for controlling a braking unit of a rope transport installation, the braking unit comprising a speed sensor delivering an acquisition signal representative of the running speed of the rope and transmitting said acquisition signal to a control unit that is able, after receipt of an external braking order, to transmit first command signals and second command signals respectively to distinct first and second braking means individually able to generate a braking force of the rope according to the corresponding command signals, wherein the command signals of the braking means are modulated by means of a first modulation circuit integrated in the control unit to automatically regulate the speed of the rope according to a first predetermined deceleration setpoint curve activated by said braking order.

The invention also relates to a braking unit of a rope transport installation, comprising:

- a speed sensor delivering an acquisition signal representative of the running speed of the rope,
- a control unit that is able, after receipt of an external braking order, to transmit first command signals and second command signals respectively to distinct first and second braking means each having a mechanical brake for slowing down the running of the rope and an actuating circuit of the brake according to the corresponding command signals,
- a first modulation circuit integrated in the control unit to modulate the command signals of the first braking means to automatically regulate the running speed of the rope according to a first predetermined deceleration setpoint curve recorded in a memory of the control unit and activated by said braking order.

STATE OF THE ART

It is compulsory for aerial ropeway transport installations, and in particular people movers, to be equipped with braking units palliating a failure of the normal driving devices. Braking units of this type generally comprise a control unit modulating the command signals of two distinct braking means. Each braking means must be dependable and equipped with positive safety means, and generally comprises a mechanical brake for slowing down the running movement of the rope, biased to the braking position by a spring, and a hydraulic circuit actuating the brake to the released position according to said command signals. The mechanical brake comprises a release jack supplied by the hydraulic circuit. The hydraulic circuit is equipped with a discharge valve for depressurizing the circuit and applying the brake, and with a feed valve supplying the circuit with oil under pressure. Any failure of the hydraulic circuit, for example a leak, automatically results in the brake being applied.

Mechanical brakes of this type can be fitted on the cabin of a telpher to grip the carrying rope and immobilize the cabin or on a driving-pulley of the hauling rope to block running of the rope.

Known braking units are such that when the control unit receives a braking order, the command signals of a first braking means are modulated during braking by a modulation circuit integrated in the control unit to regulate the running speed of the rope according to a predetermined deceleration setpoint curve recorded in a memory of the control unit.

During braking, if the deceleration is or becomes much lower than the setpoint curve, for example in the case of failure of the first braking means, the control unit automatically stops the previous modulation and the modulation circuit then starts modulating command signals of the other braking means to again regulate the running speed of the rope according to the same deceleration setpoint curve.

The setpoint curve is determined to correspond to a stopping time of the installation which is comprised between two limit values imposed by administrative regulations.

Braking units of this kind are in practice not fully satisfactory. In the event of failure of the first braking means, the time required by the second braking means to take over from the first means results in a corresponding lengthening of the braking time. This increase of the stopping time varies if switching from one braking means to the other occurs at the beginning or at the end of braking, and depends on the load transported by the rope. Moreover, because of such a sequential operation, a simultaneous failure of the two braking means increases the lengthening of the braking time. These two possible factors for causing the stopping distance to be lengthened are liable to lead to a stopping time of the rope that is greater than the maximum limit value imposed by administrative regulations, which is detrimental to safety.

OBJECT OF THE INVENTION

The object of the invention is to remedy these shortcomings by proposing a method for controlling a braking unit of a rope transport installation that procures enhanced safety.

According to the invention, this object is achieved by the fact that the command signals of the first braking means are modulated until the rope is stopped and that the command signals of the second braking means are simultaneously modulated by means of a second modulation circuit integrated in the control unit to automatically regulate the running speed of the rope according to a second predetermined deceleration setpoint curve activated by said braking order, the instantaneous value of the second curve being at all times greater than the value of the first curve.

Such a method guarantees that the braking unit can deliver a braking force resulting from the simultaneous action of two modulated braking means. In normal braking, i.e. without failure of the first braking means, the braking unit operates as in the prior art, because modulation of the command signals of the second braking means is such that its mechanical brake does not deliver any braking force. In case of failure of the first braking means on the other hand, the second braking means provides the braking force of the rope necessary to perform regulation of its speed according to the second deceleration setpoint curve. This additional force is added to the braking force procured by the mechanical brake of the first braking means the command signals whereof are then modulated in such a way that said braking force corresponds to the maximum force available during failure. The second braking means then compensate the deficit in braking force which is due to failure of the first braking means. The difference between the two deceleration setpoint curves enables a reciprocal interference (pulsation phenomenon) in the modulations of the command signals of the two braking means to be prevented.

When a failure of the first braking means occurs, coming into action of the mechanical brake of the second braking means does not give rise to any increase of the braking time because the modulations of the command signals of the two braking means are simultaneous and performed by independent modulation circuits. Moreover, in the case where the two braking means are both malfunctioning, the braking time is reduced in comparison with braking units of the prior art subjected to equivalent conditions, because the braking forces delivered by the brakes of the two malfunctioning braking means are added to one another.

The invention also relates to a braking unit of a rope transport installation. For this purpose, the control unit integrates a second modulation circuit of the command signals of the second braking means to automatically regulate the running speed of the rope according to a second predetermined deceleration setpoint curve recorded in said memory and activated by said braking order, the instantaneous value of the second curve being at all times greater than the value of the first curve.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PREFERRED EMBODIMENTS OF THE INVENTION

Figure 1:
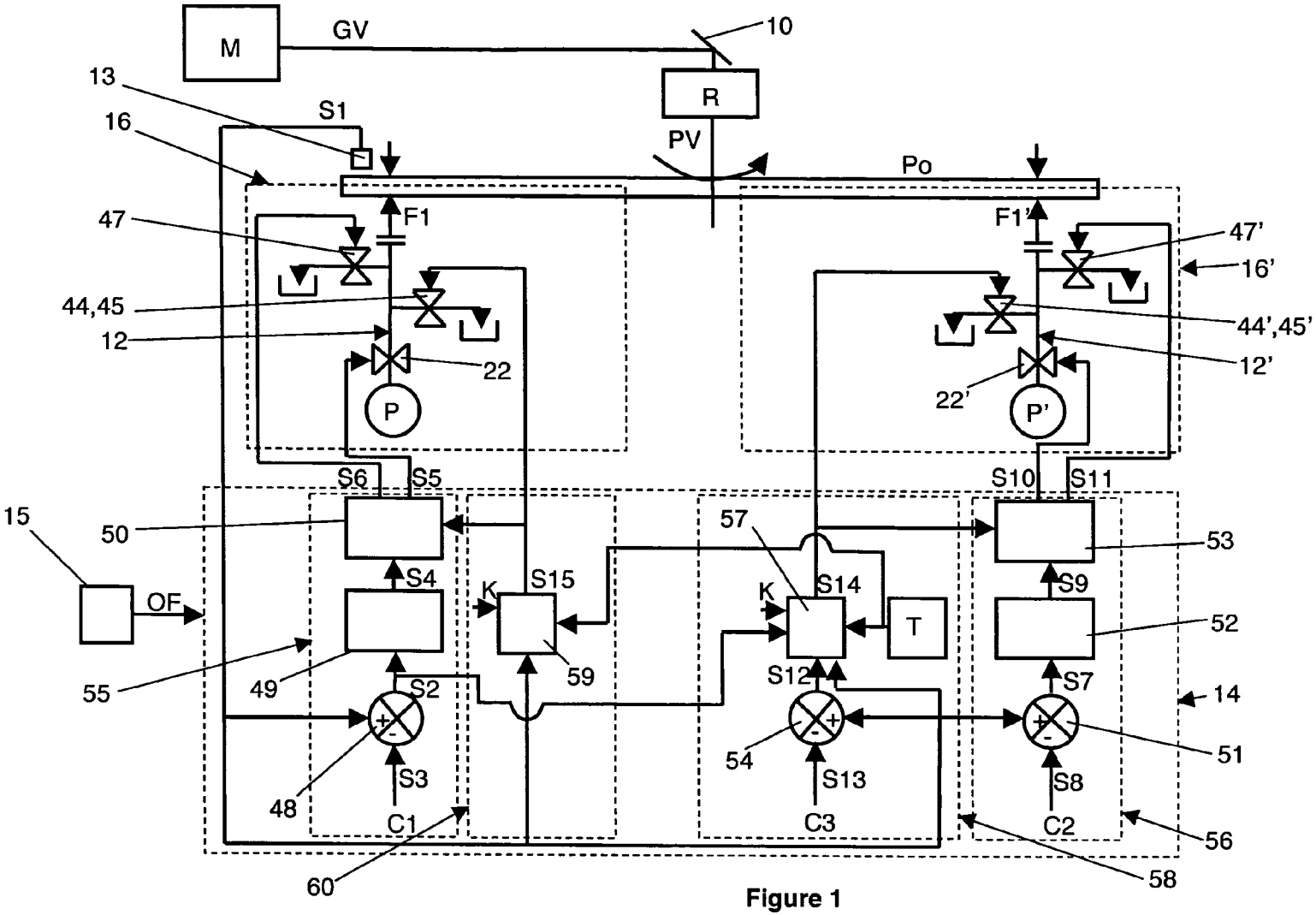
FIG. 1 is a schematic view of a drive terminal of an aerial ropeway installation equipped with a braking unit according to the invention.

In FIG. 1, a driving-pulley Po for diverting and driving a hauling rope (not represented) of an aerial ropeway installation is driven by an electric motor M via a high-speed output shaft GV which is coupled to a reduction gear R after passing via an angle transmission 10, for example at 90°, by means of conical pinions. The input shaft of the reduction gear R is associated with the angle transmission 10 and its low-speed output shaft PV is connected to the driving-pulley Po. Two mechanical brakes F1 and F1' with jaws are designed to clamp the lateral flanks of the pulley Po to slow down the rotation of the latter and therefore to slow down the running of the rope. The movable jaw of the brakes F1 and F1' is attachedly secured to a piston of a hydraulic jack and a spring urges the piston and the movable jaw to the braking position. The chamber of the jack, opposite the spring, is connected by a hydraulic pipe 11, 11' (FIG. 2) to a hydraulic circuit 12, 12', described in detail further on, performing actuation of the piston and of the movable jaw. A speed sensor 13, for example a tacho-generator, the wheel whereof is driven in rotation by the hauling rope, emits an acquisition signal S1 proportional to the running speed of the rope. The acquisition signal S1 is applied to a control unit 14. Control devices and/or detectors (derailment sensors or emergency stop button), symbolized by the rectangle referenced 15 in FIG. 1, transmit external braking orders OF to the control unit 14, in particular in case of incidents.

The brakes F1 and F1', the hydraulic pipes 11 and 11', and the hydraulic circuits 12 and 12' constitute a first braking means 16 and a second braking means 16' respectively. The braking means 16, 16', the control unit 14 which will be described in detail further on, and the speed sensor 13, constitute a braking unit of an aerial ropeway installation which is housed in a drive terminal in which the driving-pulley Po is located.

Figure 2:
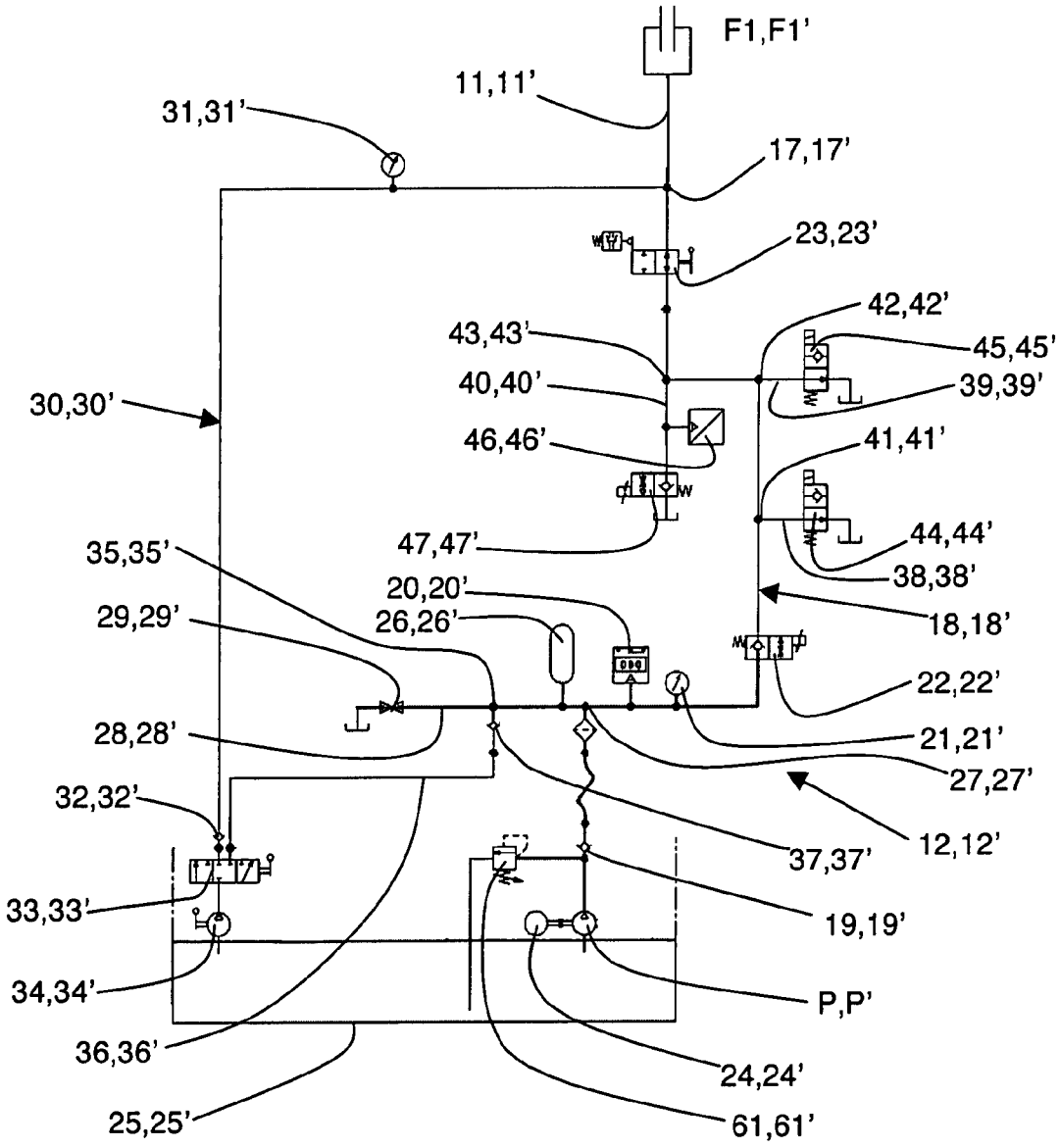
FIG. 2 is the diagram of the actuating circuit of each of the braking means of the braking unit of FIG. 1.

Only the hydraulic circuit 12 actuating the brake F1 is described in the following with reference to FIG. 2, that of the brake F1' bearing the same reference numbers with the addition of an apostrophe. The pipe 11 is connected to the outlet 17 of the hydraulic circuit 12, kept under pressure in normal operation. For this purpose, the outlet 17 is connected by a main circuit 18 comprising in series a check valve 19, a pressure control switch 20, a pressure gauge 21, a solenoid feed valve 22, and a manual isolation distributor 23, to a pump P driven by a motor 24. The inlet of the pump P communicates with a tank 25. The pressure control switch 20 and the pressure gauge 21 constitute a regulating device which controls the pump P to maintain a predetermined pressure in the hydraulic circuit 12, sufficient to keep the brake F1 in the released position. The outlet of the pump P is also connected to the tank 25 by a hydraulic pipe comprising a pressure relief valve 61.

An accumulator 26 is connected to a point 27 of the main circuit 18, intermediate between the check valve 19 and the pressure control switch 20. The accumulator 26 is also connected to the tank 25 by a first secondary circuit 28 comprising a drain valve 29 of the accumulator 26.

The outlet 17 is further connected to the tank 25 by a second secondary circuit 30 comprising in series a pressure gauge 31, a check valve 32, a three-channel manual distributor 33 and a hand pump 34. The distributor 33 is able to occupy three selective-control switching positions. In one of these positions, the distributor 33 establishes communication of the tank 25 with a point 35 of the first secondary circuit 28 intermediate between the drain valve 29 and the accumulator 26 by means of a pipe 36 comprising a check valve 37. The other two switching positions establish or do not establish feed of fluid under pressure from the hand pump 34 to the outlet 17.

A third, fourth, and fifth secondary circuits, bearing the respective reference numbers 38, 39, 40, connect the tank 25 and respective points of the main circuit 18 situated between the manual isolation distributor 23 and the solenoid feed valve 22. These points bear the respective reference numbers 41, 42, 43 for the secondary circuits 38, 39, 40 and are respectively arranged along the main circuit 18 going from the solenoid feed valve 22 to the manual isolation distributor 23. The third and fourth secondary circuits 38, 39 both comprise a solenoid safety valve, bearing the respective reference numbers 44 and 45. Moreover, the fifth secondary circuit 40 comprises in series a pressure sensor 46 and a solenoid discharge valve 47.

As illustrated in FIG. 1, in the control unit 14, the acquisition signal S1 from the speed sensor 13 is transmitted to a first comparator 48 generating a first differential signal S2 representative of the difference between the acquisition signal S1 and a first setpoint signal S3 representative of the instantaneous value of a first predetermined deceleration setpoint curve C1 (FIG. 3) and recorded in a memory (not represented) of the control unit 14. The first differential signal S2 is transmitted to a proportional integral derivative (PID) corrector 49 to deliver a first corrected signal S4 which is transmitted to a first management unit 50. On output, the first management unit 50 delivers a first opening command signal S5 of the solenoid feed valve 22 of the hydraulic circuit 12 of the first braking means 16, and a second opening command signal S6 of the solenoid discharge valve 47 of the same hydraulic circuit 12. The first comparator 48, the corrector 49, the first management unit 50, and the electrical connections conveying the signals S1 to S6 constitute a first modulation circuit 55, operation whereof will be dealt with in detail further on.

In like manner for the second braking means 16', the acquisition signal S1 is also transmitted, in the control unit 14, to a second comparator 51 generating a second differential signal S7 representative of the difference between the acquisition signal S1 and a second setpoint signal S8 representative of the instantaneous value of a second predetermined deceleration setpoint curve C2 (FIG. 3) and recorded in the memory of the control unit 14. The second differential signal S7 is transmitted to a proportional integral derivative (PID) corrector 52 to deliver a second corrected signal S9 which is transmitted to a second management unit 53. On output, the second management unit 53 delivers a third opening command signal S10 of the solenoid feed valve 22' of the hydraulic circuit 12' of the second braking means 16', and a fourth opening command signal S11 of the solenoid discharge valve 47' of the same hydraulic circuit 12'. The second comparator 51, the corrector 52, the second management unit 53, and the electrical connections conveying the signals S1 and S7 to S11 constitute a second modulation circuit 56 according to the invention, operation whereof will be dealt with in detail further on.

The parameters of the correctors 49 and 52 are chosen such as to obtain a suitable response of the method and of the regulation, the objective being to be robust, fast and precise, and to limit overshoots, which enables the influence of external conditions such as temperature being able to be ignored.

Moreover, the acquisition signal S1 is transmitted to a third comparator 54 generating a third differential signal S12 representative of the difference between the acquisition signal S1 and a command signal S13 representative of the instantaneous value of a predetermined deceleration control curve C3 (FIG. 3) and recorded in the memory of the control unit 14. The third differential signal S12 is transmitted to an input of a third management unit 57. A timer T is also connected to an input of a third management unit 57.

The first differential signal S2 output from the first comparator 48 is further transmitted to a third input of the third management unit 57. The acquisition signal S1 is also transmitted to a fourth input of the third management unit 57. According to the differential signals S1, S2, S12 and to the signal from the timer T, the third management unit 57 is able to generate a first closing command signal S14 of the solenoid safety valves 44' and 45' of the hydraulic circuit 12' of the second braking means 16'. The first closing command signal S14 is also transmitted to the second management unit 53. The third comparator 54, the third management unit 57, the timer T, and the electrical connections conveying the signals S1, S2 and S12 to S14 constitute a first emergency stop circuit 58, operation whereof will be dealt with in detail further on.

In the control unit 14, the acquisition signal S1 is also transmitted to an input of a fourth management unit 59, the other input whereof is connected to the output of the timer T. Depending on the signals received, the fourth management unit 59 is able to generate a second closing command signal S15 of the solenoid safety valves 44 and 45 of the hydraulic circuit 12 of the first braking means 16. The second opening command signal S15 is also transmitted to the first management unit 50. The fourth management unit 59, the timer T, and the electrical connections conveying the signals S1 and S15 constitute a second emergency stop circuit 60 the operation whereof will be dealt with in detail further on.

In addition, the management units 57, 59 deliver the closing command signals S14 and S15 when the acquisition signal S1 is representative of a running speed of the rope that is lower than or equal to a preset value K.

In an alternative embodiment of the invention, the braking unit comprises two distinct speed sensors 13. One of the sensors 13 is then connected to the first modulation circuit 55 and the other of the sensors 13 is connected to the second modulation circuit 56. Such a structure guarantees that each braking means 16, 16' has its own electrical power supply. Thus, in the event of an electrical failure, only the mechanical brake F1, F1' of the braking means 16, 16' whose electrical power supply has failed is commanded to its maximum braking position to prevent too sharp braking of the rope which would be liable to cause derailment of the rope from its guiding means, in particular at the level of the rollers of guide pulley array. The management units 50, 53, 57, 59 can nevertheless be grouped in a unitary management unit such as a programmable controller.

Figure 3:
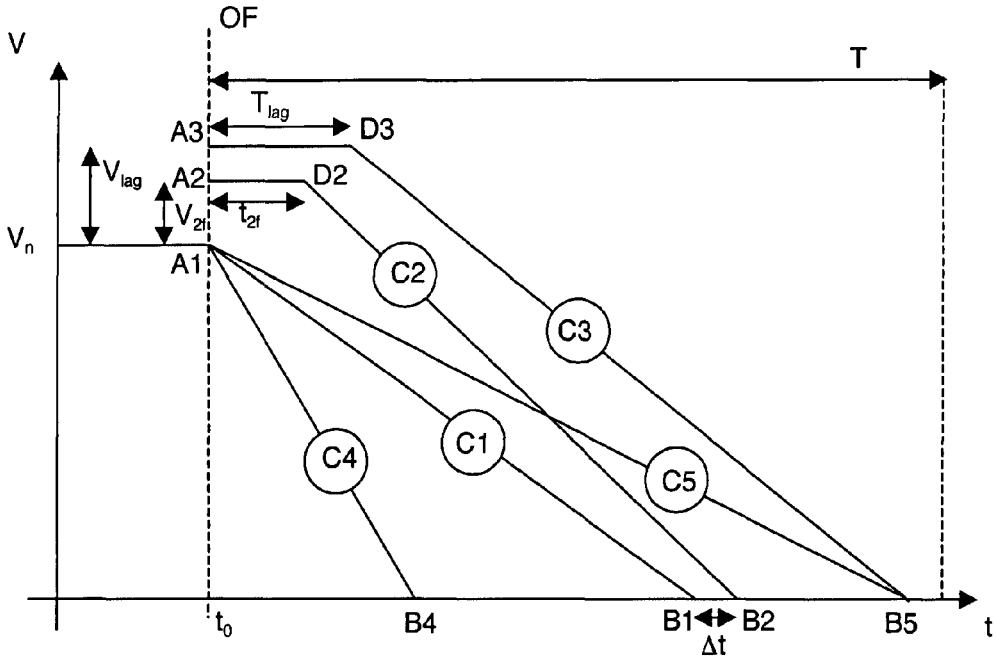
FIG. 3 illustrates the evolution over time of the deceleration setpoint curves and of a deceleration control curve integrated in a memory of the control unit of the braking unit of FIG. 1, from the moment an external braking order is received.

FIG. 3 illustrates the evolution in time of the first and second deceleration setpoint curves C1 and C2 and of the deceleration control curve C3 from the moment an external braking order OF transmitted by the control means and/or the detectors 15 is received. For this purpose, the time t is materialized by the x-axis (horizontal axis) and the running speed V of the rope is materialized by the y-axis (vertical axis). From a nominal speed $V_n$, which corresponds to the nominal running speed of the rope when the installation is in steady operating conditions, the control means and/or the detectors 15 transmit a braking order OF to the control unit 14 at an initial time noted $t_0$. Receipt of the braking order OF activates reading of the setpoint curves C1, C2 and of the control curve C3 stored in the memory of the control unit 14. What is meant by reading a curve is the action of determining the instantaneous value of the curve at each moment, continuously and in real time. This operation can also be applied with a preset sampling frequency.

As illustrated in FIG. 3, the first deceleration setpoint curve C1 is a descending straight line passing through the point A1 with abscissa $t_0$ and ordinate $V_n$. The curve C1 cuts the x-axis at a point B1. It is situated in the angular sector delineated by two descending straight lines noted C4 and C5, both passing through the point A1. The directing coefficient of the line C4 is lower than that of the line C5. The lines C4 and C5 cut the x-axis at two distinct points respectively noted B4 and B5. The abscissa of the point B4 is much lower than the abscissa of the point B5, and the point B1 belongs to the segment the limits whereof are B4 and B5. The difference of abscissa between the points A1 and B4 corresponds to the minimum limit value of the stopping time of the installation imposed by administrative regulations. Likewise, the difference of abscissa between the points A1 and B5 corresponds to the maximum limit value of the stopping time of the installation imposed by administrative regulations. Consequently, the first setpoint curve C1 is determined to correspond to a stopping time required for the installation that is comprised between the regulatory limit values.

The second deceleration setpoint curve C2 is made up of a first section of horizontal line passing through a point noted A2 with abscissa $t_0$ and ordinate greater than $V_n$. More precisely, the difference between the ordinate of the point A2 and $V_n$ is noted $V_{2f}$. The end point of the horizontal section is noted D2. The abscissa of the point D2 is greater than $t_0$ and its ordinate is equal to that of the point A2. The difference between the abscissa of the point D2 and $t_0$ is noted $t_{2f}$. The horizontal section is extended by a descending straight line section cutting the x-axis at a point B2 intercalated between the points B1 and B5. The difference of abscissa between the points B2 and B1 is noted Δt.

Consequently, the instantaneous value of the second deceleration setpoint curve C2 is greater than the instantaneous value of the first deceleration setpoint curve C1 at each time of reading. On a first part of the second deceleration setpoint curve C2 on the other hand, its value is greater than the instantaneous value of the curve C5 at each time of reading. But on the remaining part of the curve C2, its instantaneous value is lower than the instantaneous value of the curve C5 at each time of reading. Consequently, the second setpoint curve C2 is determined to correspond to a stopping time required for the installation that is lower than the regulatory maximum limit value.

The control curve C3 is for its part made up of a first section of horizontal line passing through a point noted A3 of abscissa $t_0$ and ordinate greater than $V_n$. More precisely, the difference between the ordinate of the point A3 and $V_n$ is noted $V_{lag}$. The end point of the horizontal section is noted D3. The abscissa of the point D3 is greater than $t_0$ and its ordinate is equal to that of the point A3. The difference between the abscissa of the point D3 and $t_0$ is noted $t_{lag}$. The value of $t_{lag}$ is greater than $t_{2f}$. The horizontal section is extended by a descending straight line section cutting the x-axis at the point B5.

The instantaneous value of the second control curve C3 is consequently greater than the instantaneous value of the second deceleration setpoint curve C2 at each time of reading.

The values of $V_{lag}$, $V_{2f}$, $t_{2f}$, $t_{lag}$, Δt are parameters internal to the control unit and can be modified by means of a man-machine interface that is not represented. Any correction made to the value of these parameters modifies the profile of the curves C1, C2 and C3 concerned by said correction accordingly. The modifications made to the curves are automatically recorded in the control unit memory.

FIG. 3 also illustrates that the value of the preset time delay that is triggered on automatic activation of the timer T caused by receipt of the braking order OF is greater than the difference between the abscissa of the point B5 and the abscissa $t_0$.

The braking unit operates in the following manner:

In normal operation of the installation, the first management unit 50 transmits the first opening command signal S5 to the solenoid feed valve 22. Likewise, the second management unit 53 transmits the third opening command signal S10 to the solenoid feed valve 22'. As the solenoid feed valves 22, 22' are of the "open-fed" type, they are then open. The solenoid discharge valves 47, 47' are on the other hand closed. The third management unit 57 transmits the first closing command signal S14 to the solenoid safety valves 44', 45' and to the second management unit 53. The fourth management unit 59 transmits the second closing command signal S15 to the solenoid safety valves 44, 45 and to the first management unit 50. The solenoid safety valves 44, 45, 44', 45' are therefore closed. The hydraulic circuits 12, 12' are under pressure. The oil under pressure comes from the accumulators 26, 26'. The manual isolation distributors 23, 23' are open and the pipes 11, 11' are under pressure. The mechanical brakes F1, F1' are therefore released. The check valves 32, 32' are closed. The running speed of the rope is equal to the nominal speed $V_n$.

According to an independent functioning of the actions which will be described further on in the present, the oil pressure in the accumulators 26, 26' is continually maintained to be comprised between a high threshold and a low threshold, whether it be in stabilized operating conditions of the installation or during braking. When the pressure in a circuit 12, 12' reaches the low threshold (for example 102 bars), the corresponding pressure control switch 20, 20' triggers start-up of the associated pump P, P'. By suction from the tank 25, the pump P, P' in operation discharges the oil under pressure to the associated accumulator 26, 26' and to the associated solenoid feed valve 22, 22', regardless of the state of said solenoid feed valve 22, 22'. When the pressure in the circuit 12, 12' reaches the high threshold (for example 110 bars) on the other hand, the corresponding pressure control switch 20, 20' commands shutdown of the associated pump P, P'. In case of malfunctioning of the pressure control switch 20, 20' at the moment the high threshold is detected, the associated pressure relief valve 61, 61', which is calibrated to a preset value (for example 116 bars), opens and the excess oil returns directly to the tank 25. After a pre-programmed time, the control unit 14 automatically performs stopping of the pump P, P' which is running. Furthermore, in case of malfunctioning of a pump P, P', it is possible to actuate the associated hand pump 34, 34'. The three-channel manual distributor 33, 33' is then commanded to the position selecting communication between the hand pump 34, 34' and the pipe 36. By suction from the tank 25, the oil thus pumped tops up the oil level in the accumulator 26, 26' and in the associated hydraulic circuit 12, 12'.

A braking order OF transmitted by the control means and/or the detectors 15 to the control unit 14 causes the traction of the electric motor M to be interrupted and activates the management units 50, 53, 57, 59. The first management unit 50 sends back the second opening command signal S6 to the solenoid discharge valve 47. As the latter is of the "open-fed" type, the solenoid discharge valve 47 opens and the oil under pressure is removed to the tank 25 via the fifth secondary circuit 40. At the same time, the first management unit 50 stops transmitting the first opening command signal S5 and the solenoid feed valve 22 closes. The oil pressure in the main circuit 18 and in the pipe 11 decreases. The mechanical brake F1 closes progressively under the action of the spring and the jaws come into contact with the driving-pulley Po. Furthermore, activation of the second management unit 53 by the braking order OF in return causes transmission of the fourth opening command signal S11 to the solenoid discharge valve 47'. As the latter is of the "open-fed" type, the solenoid discharge valve 47' opens and the oil under pressure is removed to the tank 25 via the fifth secondary circuit 40'. At the same time, the second management unit 53 stops transmitting the third opening command signal S10 to the solenoid feed valve 22'. The oil pressure in the main circuit 18' and in the pipe 11' decreases. The mechanical brake F1' closes progressively under the action of the spring and the jaws come into contact with the driving-pulley Po.

The value of the contact pressure of the jaws of the mechanical brakes F1, F1' is adjusted by the hydraulic pressure indicated by the pressure sensors 46, 46'. The brakes therefore move towards the driving-pulley Po with maximum celerity. The approach time is extremely small (considered as negligible in the explanations of FIG. 3). These pressures can be different to prevent any interference between the brakes F1 and F1'.

Receipt of the braking order OF also activates the timer T which in return triggers the preset time delay during which the timer T does not transmit any signal to the third and fourth management units 57 and 59.

At the moment the oil pressure in the fifth secondary circuits 40, 40' reaches the pressure value indicated by the pressure sensors 46, 46', the management units 50, 53 and 57 trigger activation and simultaneous reading of the deceleration setpoint curves C1 and C2 and of the control curve C3 which are stored in the memory of the control unit 14. During the remaining part of the braking operation, the instantaneous value of the curves C1 to C3 determined at each moment by reading of the memory is translated, in real time, into a representative signal. The first and second setpoint signals S3 and S8 are thus, at all times, representative respectively of the instantaneous values of the deceleration setpoint curves C1 and C2. In like manner, the command signal S13 is, at all times, representative of the control curve C3.

In parallel with the operations of the previous paragraph, the first comparator 48 establishes in real time the difference between the acquisition signal S1 coming from the speed sensor 13 and the first setpoint signal S3. The first corrected signal S4 on output from the corrector 49 is at all times directly representative of the first differential signal S2. According to the signal S4, the first management unit 50 commands opening of the solenoid discharge valve 47 and of the solenoid feed valve 22. In parallel, the second comparator 51 establishes in real time the difference between the acquisition signal S1 and the second setpoint signal S8. The second corrected signal S9 on output from the corrector 52 is at all times directly representative of the second differential signal S7. According to the signal S9, the second management unit 53 commands opening of the solenoid discharge valve 47' and of the solenoid feed valve 22'.

More precisely, as the first deceleration setpoint curve C1 is a descending straight line, the first corrected signal S4 tends to increase because the contact pressure of the jaws of the brake F1 does not then enable a sufficient braking force to be provided. Consequently, the first management unit 50 continues transmitting the second opening command signal S6 to the solenoid discharge valve 47, which therefore continues to be open. The oil pressure in the main circuit 18 and in the pipe 11 is still decreasing and the mechanical brake F1 closes progressively. The braking force continues to increase and the running speed of the rope decreases.

If the deceleration is or becomes too great, the first management unit 50 transmits the first opening command signal S5 to the solenoid feed valve 22 and stops transmitting the second opening command signal S6 to the solenoid discharge valve 47. The liquid of the accumulator 26 feeds the hydraulic circuit 12 tending to increase the pressure in the circuit and to open the brake F1. Slowing-down of the rope decreases and as soon as the deceleration reverts to the normal value on the corresponding curve, the first management unit 50 commands closing of the solenoid feed valve 22 and opening of the solenoid discharge valve 47. By suitable management of transmission of the signals S5 and S6 by the first management unit 50, the first modulation circuit 55 thereby performs automatic regulation of the braking action generated by F1, and consequently of the running speed of the rope, according to the first deceleration setpoint curve C1.

As far as the second braking means 16' are concerned, at the moment the oil pressure in the fifth secondary circuit 40' reaches the pressure value indicated by the pressure sensors 46', the management unit 53 stops transmitting the signals S10 and S11 so as to close the solenoid feed valve 22' and the solenoid discharge valve 47'. The contact pressure of the jaws of the brake F1' stabilizes. As the instantaneous value of the second setpoint curve C2 is at all times greater than the value of the first setpoint curve C1, the second differential signal S7 remains very high (in absolute value), because the running speed of the rope changes according to the automatic regulation described in the previous paragraph. As the second modulation circuit 56 performs an automatic regulation of the braking action generated by F1', and consequently of the running speed of the rope, according to the second deceleration setpoint curve C2, the second braking means 16' and the second modulation circuit 56 are kept in the contact configuration generating a negligible braking force.

Figure 4:
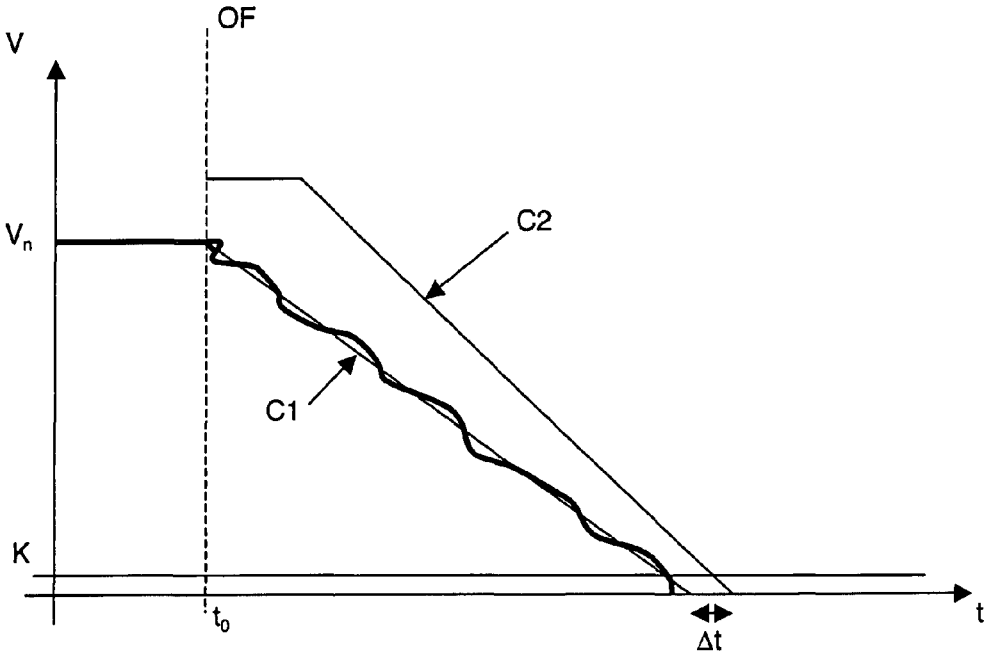
FIG. 4 illustrates the evolution over time of the running speed of the rope in the case of braking where no braking means is malfunctioning.

FIG. 4 illustrates such a braking during which the first braking means 16 are not malfunctioning, representing the curve of the change in time of the running speed of the rope measured by the speed sensor 13. Said curve oscillates around the deceleration setpoint curve C1 during braking until the preset value K is reached, which value is very low (for example 0.1 m/s). At this moment, the third and fourth management units 57 and 59 receive an acquisition signal S1 representative of a running speed of the rope which is equal to K. In return, the third management unit 57 stops transmitting the first closing command signal S14 to the solenoid safety valves 44', 45' and to the second management unit 53. At the same time, the fourth management unit 59 stops transmitting the second closing command signal S15 to the solenoid safety valves 44, 45 and to the first management unit 50. These operations command opening of the solenoid safety valves 44, 45, 44', 45' which are of the 'open-not fed' type, which results in the oil under pressure returning to the tank 25 and a drop of the pressure in the hydraulic pipes 11, 11'. The brakes F1 and F1' are automatically commanded to their maximum braking position in which the braking means 16, 16' generate a braking force equal to the maximum available braking force.

At the same time, at the moment when receipt of the first emergency stop signal S14 by the second management unit 53 is interrupted, the management unit 53 commands opening of the solenoid discharge valve 47' to intensify the pressure drop. For the same purpose, at the moment when receipt of the second closing command signal S15 by the first management unit 50 is interrupted, the management unit 50 commands opening of the solenoid discharge valve 47 and closing of the solenoid feed valve 22. These operations performed by the emergency stop circuits 58 and 60 enable direct braking to be applied by the braking means 16, 16', by stopping the modulations performed up to then by the modulation circuits 55 and 56, so as to guarantee that the rope is kept well in the stopped state and in particular to prevent the rope being driven by the gravity of the vehicles coupled thereon. The direct braking time can be ignored on account of the low value of K. Moreover, this direct braking is only optional for it is possible to provide for the modulation performed by the first modulation circuit 55 to be really performed until the rope is completely stopped.

Figure 5:
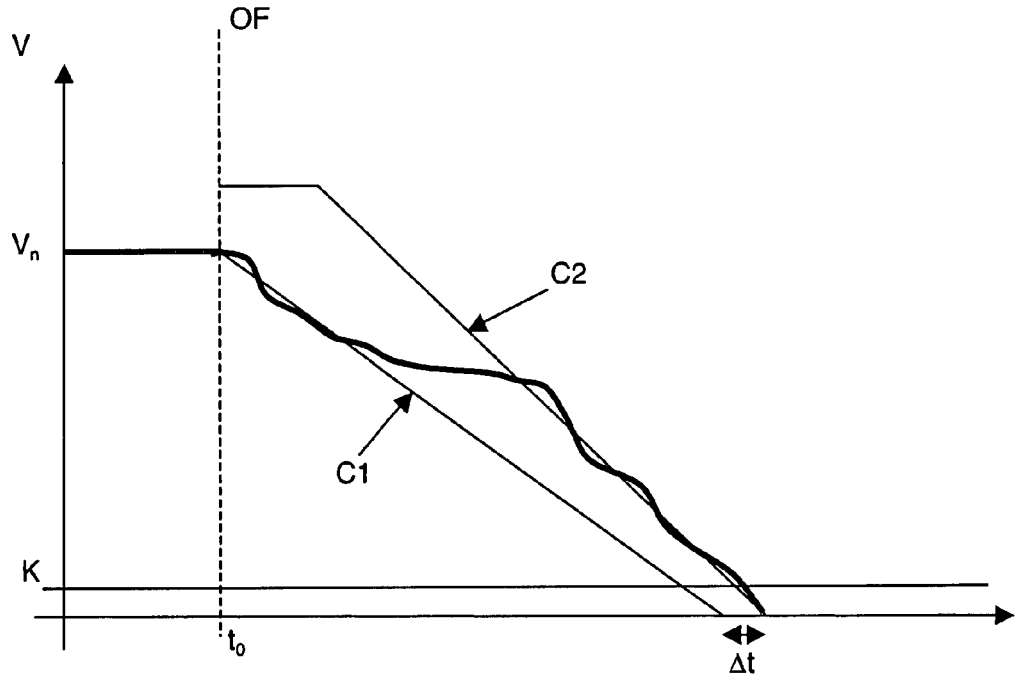
FIG. 5 illustrates the evolution over time of the running speed of the rope in the case of braking where the first braking means is malfunctioning.

FIG. 5 illustrates the case of braking during which the first braking means 16 present a failure such that, in spite of the automatic regulation performed by the first modulation circuit 55 after receipt of the braking order OF, the running speed of the rope tends to digress from the first setpoint curve C1. In concomitant manner, the second differential signal S7 decreases in absolute value and the automatic regulation of the running speed of the rope performed by the second modulation circuit 56 since the beginning of braking progressively causes an increase of the braking force generated by the brake F1'. More precisely, the second modulation circuit 56 then performs an automatic regulation of the braking force generated by the brake F1' enabling the total braking force generated by the brakes F1 and F1' to cause slowing-down of the rope that is regulated by the second deceleration setpoint C2. In parallel, the first modulation circuit 55 continues to perform the automatic regulation of the braking force, and therefore of the running speed of the rope, according to the first deceleration setpoint curve C1, in the manner described here above.

In an embodiment of the modulation and the regulation performed by the second modulation circuit 56, when the second differential signal S7 reaches a first preset positive value internal to the second management unit 53, which corresponds in this example to the time when the difference between the running speed of the rope and the setpoint curve C2 becomes greater than a preset positive value, the second management unit 53 transmits the fourth opening command signal S11 to the solenoid discharge valve 47' which opens. The oil pressure in the main circuit 18' and in the pipe 11' decreases and the mechanical brake F1' closes progressively. The braking force increases and the running speed of the rope decreases more strongly.

When the second differential signal S7 reaches a preset second negative value internal to the second management unit 53, which corresponds in this example to the time when the difference between the running speed of the rope and the setpoint curve C2 becomes lower than a preset negative value, the second management unit 53 transmits the third opening command signal S10 to the solenoid discharge valve 22' and stops transmitting the fourth opening command signal S11 to the solenoid discharge valve 47'. The liquid of the accumulator 26' feeds the hydraulic circuit 12' tending to increase the pressure in the circuit and to open the brake F1'. Slowing-down of the rope decreases and as soon as the deceleration reverts to the normal value on the corresponding deceleration curve, the second management unit 53 again commands closing of the solenoid feed valve 22' and opening of the solenoid discharge valve 47'. The curve of the change in time of the running speed of the rope oscillates around the second deceleration setpoint curve C2 during the second part of braking until the preset value K is reached. At this stage, as before, the management units 57 and 59 stop transmitting the closing command signals S14 and S15 to the solenoid safety valves 44, 45, 44', 45' and to the management units 50 and 53.

It is possible to provide other embodiments of the modulation and the regulation performed by the second modulation circuit 56, in which the control unit 14 commands opening of the solenoid discharge valve 47' before the speed of the rope exceeds the second deceleration setpoint curve C2. In this case, the second management unit 53 can perform modulation of the opening command signals S10 and S11 enabling simultaneous transmission of the two signals S10 and S11. This possible operating mode enables the pressure drop in the hydraulic pipe 11' to be modulated.

Figure 6:
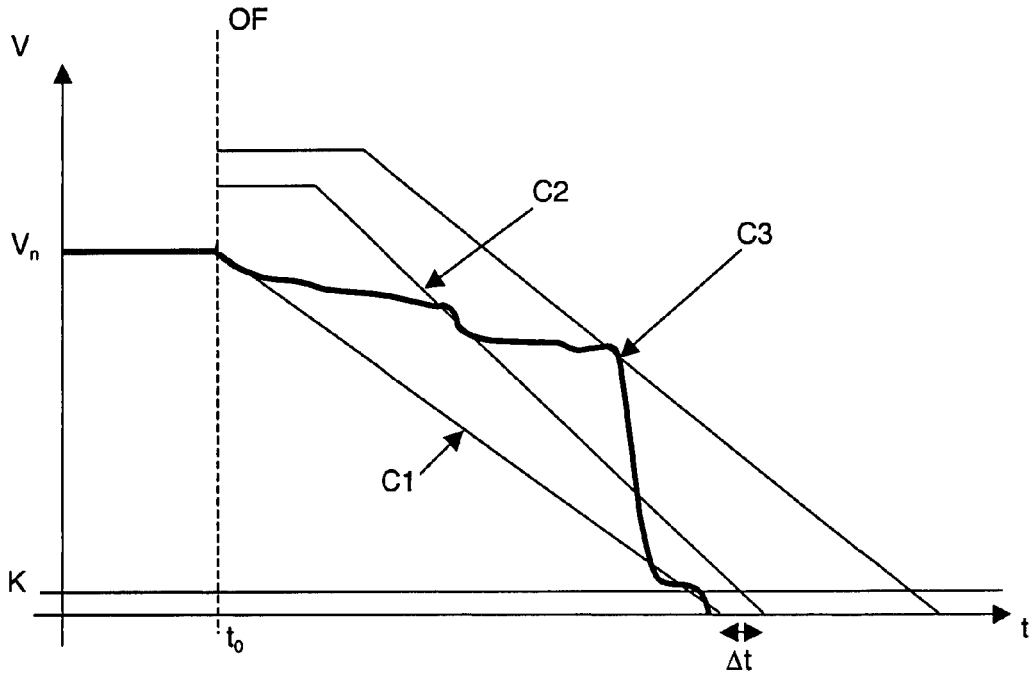
FIG. 6 illustrates the evolution over time of the running speed of the rope in the case of braking where both the braking means are malfunctioning.

FIG. 6 illustrates the case of braking during which the two braking means 16, 16' present a failure such that, despite the regulations performed by the modulation circuits 55, 56 after receipt of the braking order OF, the running speed of the rope tends to digress from the second deceleration setpoint curve C2. In concomitant manner, the third differential signal S12 decreases in absolute value. When the acquisition signal S1 becomes representative of a running speed of the rope that is greater than the instantaneous value of the control curve C3, which corresponds to the time when the third differential signal S12 becomes equal to zero and then changes sign, the third management unit 57 stops transmitting the first closing command signal S14. The solenoid safety valves 44' 45' open and the brake F1' is commanded to the maximum braking position in which the braking means 16' generate a braking force equal to the maximum available braking force. In parallel, the first modulation circuit 55 continues performing regulation of the braking force generated by F1, and therefore of the running speed of the rope, according to the first deceleration setpoint curve C1, in the manner described here above.

This step is illustrated in FIG. 6 by a sharp decrease of the speed of the rope. One of the inputs of the third management unit 57 continuously receives the first differential signal S2. If, as in FIG. 6, this decrease is such that the running speed of the rope becomes lower than the first setpoint curve C1, the change of sign of the first differential signal S2 results, at the level of the management unit 57, in transmission of the first closing command signal S14 being re-established. This has the consequence of re-establishing the modulation performed up to now by the second modulation circuit 56.

An external releasing order of the brakes F1, F1' received by the control unit 14 after the installation has been stopped causes start-up of the pumps P, P' and recharging of the hydraulic circuits 12, 12', the pipes 11, 11' and the accumulators 26, 26'. In case of maintenance, closing the manual isolation distributor 23, 23' enables the pipe 11, 11' to be isolated and the brake F1, F1' to be kept in the open position. In this case, the pressure in the pipe 11, 11' can be established by the hand pump 34, 34' by means of the second secondary circuit 30, 30'. Moreover, the drain valve 29, 29', in the open position, enables the liquid contained in the corresponding accumulator to be removed to the tank 25.

In all the previously described braking cases, the management units 57 and 59 stop transmitting the closing command signals S14 and S15 if the acquisition signal S1 is representative of a rope running speed greater than zero after the preset time delay triggered by automatic activation of the timer T caused by receipt of the braking order OF.

Absence of transmission of the first closing command signal S14 by the third management unit 57 can be assimilated to delivery of a first emergency stop signal by the first emergency stop circuit 58. On the contrary, transmission of the first closing command signal S14 can be assimilated to the absence of generation of the first emergency stop signal by the first emergency stop circuit 58. In similar manner, absence of transmission of the second closing command signal S15 by the fourth management unit 59 can be assimilated to delivery of a second emergency stop signal by the second emergency stop circuit 60. On the contrary, transmission of the second closing command signal S15 can be assimilated to the absence of generation of the second emergency stop signal by the second emergency stop circuit 60. More precisely, it can be considered that the first and second emergency stop signals are generated by the third and fourth management units 57, 59 respectively. In other alternative embodiments of a braking unit where the solenoid safety valves 44, 45, 44', 45' are of the "open-fed" type, the first and second closing command signals S14 and S15 directly constitute the first and second emergency stop signals respectively.

By suitable management of transmission of the signals S5, S6, S10, S11 by the management units 50 and 53, the modulation circuits 55, 56 each perform a regulation of the braking action generated by the associated mechanical brake F1, F1', and consequently of the running speed of the rope, according to the corresponding deceleration setpoint curve C1, C2. The basic principle for each of these two regulations is to measure the difference between the actual speed of the rope and the value sought for (setpoint curves C1 or C2), and to operate the mechanical brakes F1, F1' acting on the actual speed to reduce this difference by a suitable modulation of the setpoint signals S5, S6, S10, S11 which command the hydraulic circuits 12, 12' actuating the brakes F1, F1'.

One or the other of the first and second braking means 16, 16' can consist of an electromagnetic brake provided on the high-speed output shaft GV and controlled by the control unit 14, without this alternative embodiment departing from the scope of the invention. Moreover, the invention can be applied to any rope transport installation implementing a braking unit provided with two distinct braking means each having a mechanical brake for slowing down running of the rope and an actuating circuit of the brake, with a speed sensor delivering an acquisition signal representative of the running speed of the rope, and with a control unit able to transmit command signals to the actuating circuits of the braking means, such as for example a chairlift or gondola car/cabin installation.

The invention claimed is:

1. Method for controlling a braking unit of a rope transport installation, the braking unit comprising a speed sensor delivering an acquisition signal representative of the running speed of the rope and transmitting said acquisition signal to a control unit that is able, after receipt of an external braking order, to transmit first command signals and second command signals respectively to distinct first and second braking means individually able to generate a braking force of the rope according to the corresponding command signals, wherein the command signals of the braking means are modulated by means of a first modulation circuit integrated in the control unit to automatically regulate the speed of the rope according to a first predetermined deceleration setpoint curve activated by said braking order, wherein the command signals of the first braking means are modulated until the rope is stopped and wherein the command signals of the second braking means are simultaneously modulated by means of a second modulation circuit integrated in the control unit to automatically regulate the running speed of the rope according to a second predetermined deceleration setpoint curve activated by said braking order, the instantaneous value of the second curve being at all times greater than the value of the first curve.

2. Method according to claim 1, wherein a first emergency stop signal is transmitted to the second braking means by means of a first emergency stop circuit integrated in the control unit, when the acquisition signal is representative of a running speed of the rope greater than a predetermined deceleration control curve activated by said braking order, the instantaneous value of the control curve being at all times greater than the values of the first and second setpoint curves, to command stopping of the modulation performed by the second modulation circuit and generation by the second braking means of a braking force equal to the maximum available braking force.

3. Method according to claim 2, wherein the first emergency stop circuit generates the first emergency stop signal if the acquisition signal is representative of a running speed of the rope greater than zero after a predetermined time delay activated by said braking order.

4. Method according to claim 3, wherein a second emergency stop signal is transmitted to the first braking means by means of a second emergency stop circuit integrated in the control unit if the acquisition signal is representative of a running speed of the rope greater than zero after said predetermined time delay, to command stopping of the modulation performed by the first modulation circuit and generation by the first braking means of a braking force equal to the maximum available braking force.

5. Method according to claim 4, wherein the emergency stop circuits generate the corresponding emergency stop signals when the acquisition signal is representative of a running speed of the rope lower than or equal to a preset value.

6. Braking unit of a rope transport installation, comprising:

a speed sensor delivering an acquisition signal representative of the running speed of the rope, a control unit that is able, after receipt of an external braking order, to transmit first command signals and second command signals respectively to distinct first and second braking means each having a mechanical brake for slowing down the running of the rope and an actuating circuit of the brake according to the corresponding command signals, a first modulation circuit integrated in the control unit to modulate the command signals of the first braking means to automatically regulate the running speed of the rope according to a first predetermined deceleration setpoint curve recorded in a memory of the control unit and activated by said braking order, wherein the control unit integrates a second modulation circuit of the command signals of the second braking means to automatically regulate the running speed of the rope according to a second predetermined deceleration setpoint curve recorded in said memory and activated by said braking order, the instantaneous value of the second setpoint curve being at all times greater than the value of the first setpoint curve.

7. Braking unit according to claim 6, wherein each of the first and second modulation circuits comprises, connected in series:

a comparator generating a differential signal representative of the difference between the acquisition signal and a setpoint signal representative of the instantaneous value of the corresponding setpoint curve, a corrector of the differential signal, a management unit delivering an opening command signal of a feed valve and an opening command signal of a discharge valve, said valves being integrated in the actuating circuit of the corresponding braking means.

8. Braking unit according to claim 6, wherein the control unit integrates a first emergency stop circuit able to transmit a first emergency stop signal to a safety valve of the actuating circuit of the second braking means when the acquisition signal is representative of a rope running speed that is greater than a predetermined deceleration control curve, the instantaneous value of the control curve being at all times greater than the values of the first and second setpoint curves, said safety valve commanding the mechanical brake of the second braking means to a maximum braking position.

9. Braking unit according to claim 8, wherein the first emergency stop circuit comprises, connected in series:

a comparator generating a differential signal representative of the difference between the acquisition signal and a control signal representative of the instantaneous value of the control curve, a management unit able to deliver the first emergency stop signal when said differential signal is equal to zero.

10. Braking unit according to claim 6, wherein the control unit integrates a second emergency stop circuit able to transmit a second emergency stop signal to a safety valve of the actuating circuit of the first braking means if the acquisition signal is representative of a rope running speed greater than zero after a preset time delay activated by said braking order, said safety valve commanding the mechanical brake of the first braking means to a maximum braking position.

* * * * *